United States Patent [19]

Dranselka

[11] 4,026,522

[45] May 31, 1977

[54] POST PULLING APPARATUS

[76] Inventor: Marvin A. Dranselka, R.R. 1, Wayne, Nebr. 68787

[22] Filed: Sept. 9, 1976

[21] Appl. No.: 721,017

[52] U.S. Cl. ..... 254/30; 254/132

[51] Int. Cl.[2] ..... B66F 3/00

[58] Field of Search ..... 254/29 R, 30, 31, 132; 294/113

[56] References Cited

UNITED STATES PATENTS

| | | | |
|---|---|---|---|
| 2,482,950 | 9/1949 | Toftey | 254/30 |
| 3,549,126 | 8/1968 | De Vries | 254/132 |

*Primary Examiner*—James L. Jones, Jr.
*Assistant Examiner*—Robert C. Watson
*Attorney, Agent, or Firm*—Henderson, Strom & Sturm

[57] ABSTRACT

A self-engaging post pulling apparatus is disclosed which is readily adapted for attachment to the rear lifting mechanism of most commonly used tractors. The post pulling apparatus comprises generally a horizontal support member having two opposed plates pivotably mounted thereon for frictionally engaging a post positioned therebetween. The plates are biased into a gripping position by helical springs, but may be remotely moved to a non-gripping position by cables affixed to the plates.

7 Claims, 5 Drawing Figures

POST PULLING APPARATUS

BACKGROUND OF THE INVENTION

This invention generally relates to post pulling apparatus, and specifically to a post pulling apparatus which is self-engaging and which may alternatively be remotely disengaged.

Fencing is very common throughout the world, especially in those areas where it is customary to keep livestock. A good fence is a valuable asset of the landowner, and its upkeep, including erection, repair, and replacement is necessary and laborious.

When pulling a post, it is necessary to either manually dig around the post or use some mechanical device because of the impacted ground embracing the post and the suction created in the post hole when the post is raised. There are, of course, numerous post pulling apparatus adapted to be operatively connected with a farm vehicle now on the market, but the majority of these units necessitate the employment of chains and the like and as a consequence, require the operator to leave the controls or to have a second person available.

Recently, there have been developed self-engaging post pulling apparatus, such as that disclosed in U.S. Pat. No. 3,549,126, which is effective in accomplishing the desired purpose; however, such device does not provide for the protection of the operator during the extraction of particularly large and long posts, nor does it provide for vertical stability of a post being removed. The apparatus of the instant invention is designed to overcome these problems.

SUMMARY OF THE INVENTION

It is therefor an object of this invention to provide a novel fence post pulling apparatus.

It is another object of this invention to provide an improved fence post pulling apparatus which is safe and convenient to operate.

It is a further object of this invention to provide a fence post pulling apparatus that is self-engaging and operable by a single individual.

It is a further object of this invention to provide a self-engaging fence post pulling apparatus that adapts to conventional lift mechanisms readily available on the farm; namely, a tractor or a hydraulic hitch assembly commonly attached rearward of many tractors.

It is a still further object of this invention to provide a self-engaging fence post pulling apparatus that is economical to manufacture, simple in use and design, and rugged in construction.

It is an even still further object of this invention to provide a self-engaging fence post pulling apparatus that may be remotely disengaged from the post after extraction thereof from the ground.

These and other objects are accomplished by providing a self-engaging post pulling apparatus which is readily adapted for attachment to the rear lifting mechanism of most commonly used tractors. The post pulling apparatus comprises generally a horizontal support member having two opposed plates pivotably mounted thereon for frictionally engaging a post positioned therebetween. The plates are biased into a gripping position by helical springs, but may be remotely moved to a non-gripping position by cables affixed to the plates.

BRIEF DESCRIPTION OF THE DRAWINGS

The advantages of this invention will become apparent upon consideration of the following detailed disclosure of the invention, especially when taken in conjunction with the accompanying drawings wherein.

DESCRIPTION OF THE PREFERRED EMBODIMENTS

Figure 1:
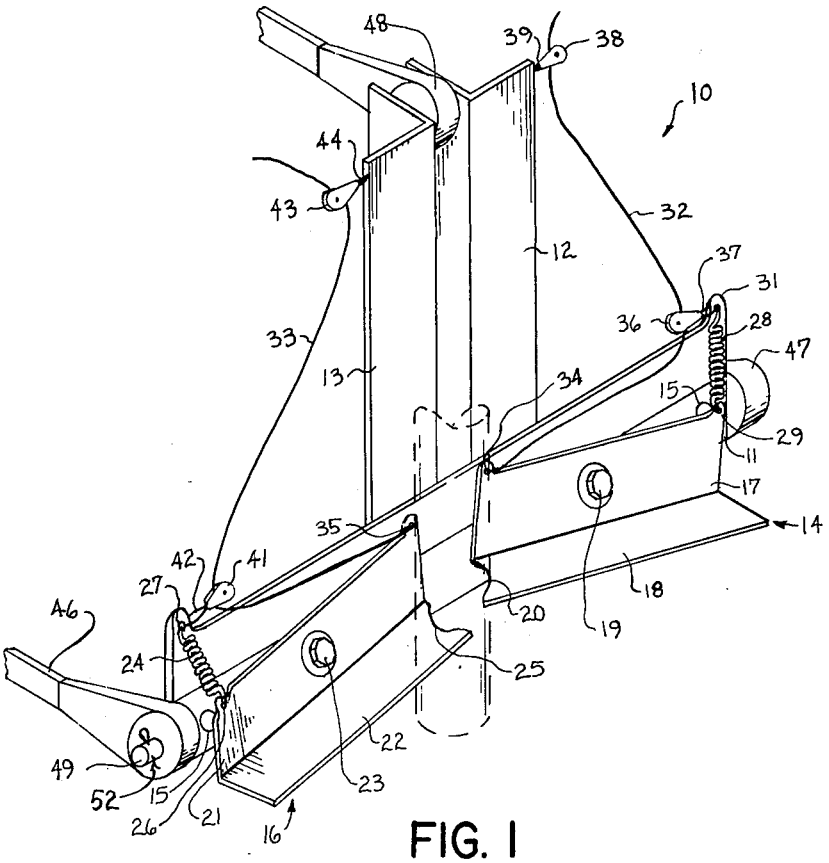
FIG. 1 is a partially schematic perspective view of the post pulling apparatus showing attachment to a lifting mechanism.
Figure 2:
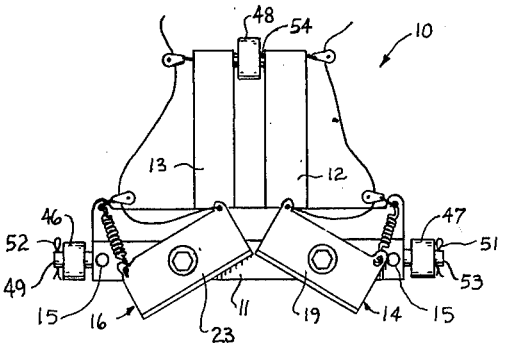
FIG. 2 is a front plane view of the post pulling apparatus showing the general arrangement of elements.

Referring now to the drawings, and particularly FIGS. 1 and 2, the post pulling apparatus is indicated generally by the numeral 10, and is shown in assembled relation with portions of a tractor hitch assembly.

The post pulling apparatus 10 of this invention comprises generally a rigid horizontal support member 11 having rigid vertical support members 12 and 13 affixed thereto. The vertical support members may be affixed to the horizontal support member 11 in any suitable fashion, such as, for example, welding. The two vertical support members are affixed substantially to the center of the horizontal support member 11 and protrude away therefrom, thereby forming somewhat of an inverted T structure. Any suitable material may be used for the support members 11, 12 and 13, such as the angle irons shown in the drawings. It should, however, be readily understood that other types of structural materials may be used, such, for example, as square tubing, round tubing, or flat plates.

Two gripper plates 14 and 16 are affixed to horizontal support member 11 by pivot pins 19 and 23 in such a manner that they may substantially pivot about the pins 19 and 23 in a parallel plane. Gripper plate 14 is in a substantial L configuration having legs 17 and 18 protruding substantially at 90° to each other. On one end of the leg 18 is a gripping surface 20 which may be in any suitable shape, such as the curve shown. Similarly, gripper plate 16 comprises two legs 21 and 22, and has a gripping surface 25 thereon closely adjacent gripping surface 20 of gripping plate 14. It should be readily apparent that gripping surfaces 20 and 25 are in such a relationship with each other and the pivot points 19 and 23, that a post positioned within the gripping surfaces would be frictionally engaged by the surfaces and moved in a vertical direction when the post pulling apparatus is moved in that direction. In other words, the gripping surfaces 20 and 25 reach their closest point above the horizontal plane defined by the pivot points. Thus, the lifting forces are always exerted in a generally upward direction against the post being extracted.

The gripping surfaces 20 and 25 are, importantly, biased in a downward direction so that they will be in the proper position to engage the post to be pulled. To this end, helical springs 24 and 28 are affixed to legs 21 and 17, respectively, and to the horizontal support member 11 by eye hooks 27 and 31, respectively. Obviously, any suitable method of affixing the springs to the various members may be used, and the eye hooks 26, 27, 29, and 31 are given only by way of example.

In order to engage a post with the post pulling apparatus, it is necessary that the gripping surfaces 20 and 25 be rotated away from each other to open the gap therebetween for the insertion of a post. This operation is accomplished in this embodiment, by a cable and pulley arrangement. Cable 32 is affixed to leg 17 of gripper plate 14 by an eye hook 34. The cable then extends around pulley 36 and thence through pulley 38 to a fixed position forward of the apparatus. Here again, the various elements are shown affixed to the support members and gripper plate by eye hooks, such as 34, 37 and 39. In similar fashion, cable 33 is affixed to leg 21 of gripper plate 16 and extends from eye hook 35 through pulley 41, pulley 43 and thence to a fixed position. Pulleys 41 and 43 are shown affixed to the support members by eye hooks 42 and 44. When the operator exerts a pulling force on cables 32 and 33, he intentionally causes the gripper plates 14 and 16 to pivot about pins 19 and 23, and thereby opens the gap between the gripper surfaces 20 and 25. The entire apparatus may then be moved into position relative to a post and engaged therewith for removal.

The post pulling apparatus 10 is affixed to the tractor by arms 46 and 47, which have bearing surfaces on the end thereof which engage shafts 49 and 51 respectively, extending from the ends of horizontal support member 11. The arms 46 and 47 are removably held on the shafts by pins 52 and 53. A stabilizer arm 48 extending from the tractor is affixed to the vertical support members 12 and 13 by a shaft 54 which is also held in place by a pin arrangement (not shown). The vertical support structures greatly increase the operational ability of the apparatus, and as will be shown below, the safety thereof. The tractor arms 46 and 47 are commonly raised in a vertical direction by hydraulic means. When this happens, the post pulling apparatus also moves in a vertical direction. It can readily be seen that if a post is frictionally engaged by the gripper surfaces 20 and 25, the post will necessarily be pulled in an upward direction, and thereby removed from the ground.

Figure 3:
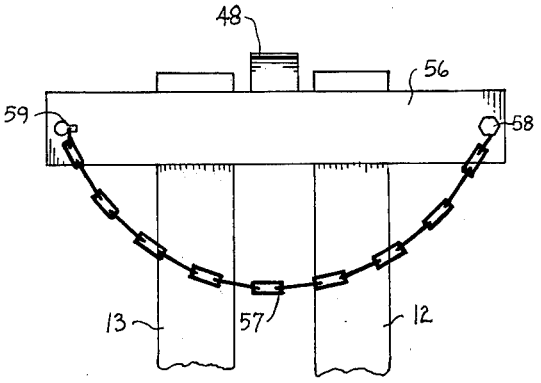
FIG. 3 is a partially schematic, front plane view of the impact plate showing the chain attachment.

Referring now to FIG. 3, an alternative embodiment of the post pulling apparatus of the instant invention is shown. The two vertical support members 12 and 13 have an impact plate 56 affixed thereto. The impact plate further has a chain member 57 affixed at one end with a shear pin 58 and removably affixed at the other end by a slot 59. This particular embodiment would advantageously be used with a hydraulic arm positioned in place of support arm 48. A post would be engaged by the gripping surfaces, the chain wrapped around the post and affixed in slot 59, and then the hydraulic arm actuated to cause a bumping of the post. This particular arrangement is very effective in removing difficult posts from the ground. Obviously, the chain member 57 serves as a safety factor and prevents larger posts from inadvertently falling away from the pulling apparatus.

Figure 4:
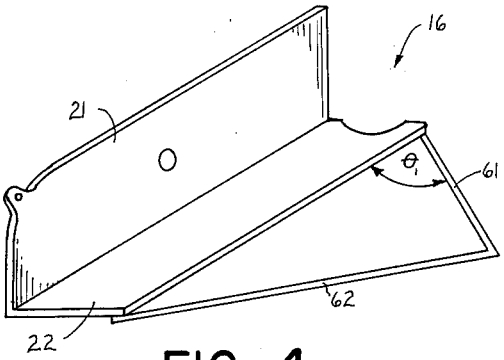
FIG. 4 is a partially schematic, perspective view of the pivot plate showing an alternative embodiment of the plate gap opening mechanism.
Figure 5:
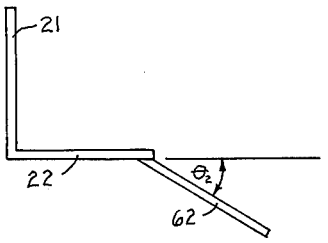
FIG. 5 is an end view of the embodiment of the pivot plate shown in FIG. 4.

Referring now to FIGS. 4 and 5, a modification of the gripper plate 16, which makes the apparatus self-engaging is shown. It should be noted that the opposing gripper plate 14 would have a similar, but reversed structure. A pusher bar 61 and support arm 62 are affixed at the ends thereof to leg 32. Pusher bar 61 is at an angle $\theta_1$ with the leg 22. Angle $\theta_1$ is an acute angle and has been found to be preferably about 60°. As shown in FIG. 5, the pusher bar 61 and support 62 also extend to an angle $\theta_2$ with the leg 22. Angle $\theta_2$ has been found to be advantageously approximately 15°. As the post pulling apparatus is moved into position on a post, the post engages pusher bar 61 and forces the gripper plate 16 to rotate about its pivot point and thereby widen the gap between the gripping surfaces. The post continues exerting a force against the pusher bar, and sliding therealong, until it is engaged by gripping surfaces 20 and 25.

It will be understood that various changes in the details, materials and arrangements of parts which have herein been described and illustrated in order to explain the nature of the invention, will occur to and may be made by those skilled in the art upon a reading of the disclosure within the principles and scope of the invention.

For example, the self-engaging hardware shown in FIGS. 4 and 5 need not be made of separate elements 61 and 62. A simple plate having a surface corresponding roughly to bar 61 would perform the same function, and would perhaps be easier to manufacture.

Also, for example, the cable system shown for manually increasing the gap between the gripping surfaces could be readily replaced by any suitable mechanical apparatus. It is obvious that a simple rod and lever arrangement would perform the same function, though perhaps not with the same degree of convenience and flexibility.

Furthermore, the versatility of the apparatus can be greatly enhanced by the incorporation of additional mounting holes for gripper plates 14 and 16. These holes 15, as shown in FIGS. 1 and 2, are in horizontal alignment and allow some additional adjustability of the gap between the gripping surface to accommodate posts of considerable size variation. Any number of holes may be fabricated into the apparatus, depending upon the size and type of posts to be encountered.

I claim:

1. A post pulling apparatus adapted to be attached to a conventional tractor lifting mechanism and stabilizer coupling, the mechanism capable of reciprocal movement in a vertical direction, the apparatus comprising:

a. a substantially rigid support member having opposed ends, said support member disposed in a substantially horizontal position and adapted to be affixed at the ends thereof to the lifting mechanism;

b. a substantially rigid stabilizing means affixed to said support member approximately midway between the ends of said support member and extending away therefrom in a vertical direction, said stabilizing means adapted to be affixed, at a point above said support member, to the stabilizer coupling;

c. clamp means for engaging the post, said clamp means including a pair of plates pivotally mounted to said support member in angular relation to each other, each of said plates having a gripping surface, the pivot points of said plates being so located that the closest point between said gripping surfaces is above the plane of the pivot points.

d. closing means urging each of said gripping surfaces toward the closest point therebetween; and e. opening means for selectively overcoming said closing means and thereby increasing the spacing between said gripping surfaces.

2. The post pulling apparatus of claim 1 wherein said closing means comprises a pair of helical springs each affixed at one end to said support member and at the other end to one of said plates, respectively, at a point remote the pivot point of said plate opposite said gripping surface.

3. The post pulling apparatus of claim 1 wherein said opening means comprises a pair of cables each affixed at one end to one of said plates, respectively, at a point remote the pivot point of said plate adjacent said gripping surface.

4. The post pulling apparatus of claim 1 wherein said opening means includes, on each said plate;

a pusher bar affixed to said plate adjacent said gripping surface remote from the pivot point of said plate, said pusher bar extending away from said plate at an acute angle with respect to a vertical plane through the pivot points of said plates and at an acute angle with respect to the longitudinal plane of said plate, whereby a force exerted on said pusher bars causes said gripping surfaces on said plates to pivot away from each other.

5. The post pulling apparatus of claim 1 wherein said stabilizing means further comprises:

an elongate rigid upright structure having a substantially planar impact surface thereon substantially in a vertical plane with the pivot points of said plates.

6. The post pulling apparatus of claim 5 further including a flexible elongate holding means adjustably affixed to said upright structure.

7. The post pulling apparatus of claim 6 wherein said closing means comprises a pair of helical springs each affixed at one end to said support member and at the other end to one of said plates, respectively, at a point remote the pivot point of said plate opposite said gripping surface.

* * * * *

UNITED STATES PATENT AND TRADEMARK OFFICE

CERTIFICATE OF CORRECTION

PATENT NO. : 4,026,522

DATED : May 31, 1977

INVENTOR(S) : Marvin A. Dranselka

It is certified that error appears in the above-identified patent and that said Letters Patent are hereby corrected as shown below:

In column 4, line 63, "pivot points." should read

--pivot points;--

Signed and Sealed this

*Twenty-eighth* Day of *November 1978*

[SEAL]

*Attest:*

RUTH C. MASON
*Attesting Officer*

DONALD W. BANNER
*Commissioner of Patents and Trademarks*